United States Patent [19]

Besse

[11] 4,117,690

[45] Oct. 3, 1978

[54] COMPLIANT OFFSHORE STRUCTURE

[75] Inventor: Celestine Paul Besse, New Orleans, La.

[73] Assignee: Chevron Research Company, San Francisco, Calif.

[21] Appl. No.: 840,695

[22] Filed: Oct. 11, 1977

Related U.S. Application Data

[63] Continuation-in-part of Ser. No. 720,035, Sep. 2, 1976.

[51] Int. Cl.[2] ..... E02B 17/00

[52] U.S. Cl. ..... 405/227; 405/208; 405/224

[58] Field of Search ..... 61/86–89, 61/92, 93, 94–98, 102, 90, 91; 166/0.5, 0.6; 175/5–10

[56] References Cited

U.S. PATENT DOCUMENTS

| | | | |
|---|---|---|---|
| 3,559,410 | 2/1971 | Blenkarn et al. | 61/87 |
| 3,654,886 | 4/1972 | Silverman | 61/95 X |
| 3,685,300 | 8/1972 | Mott et al. | 61/87 |
| 3,859,804 | 1/1975 | Koehler et al. | 61/87 |
| 3,937,027 | 2/1976 | Koehler et al. | 61/97 |

*Primary Examiner*—Dennis L. Taylor

*Attorney, Agent, or Firm*—R. L. Freeland, Jr.; Edward J. Keeling

[57] ABSTRACT

The disclosure relates to a compliant platform for use in deep water. The platform comprises a structure including a working deck positioned above the water by a plurality of leg members which are rigidly connected to the working deck and are pinned into the bottom of the body of water. Horizontal bracing members are rigidly connected between the leg members. Vibration-influencing means are located on the structure to provide the structure with a first mode of vibration with a frequency less than the frequency of the peak of spectral wave density profile expected in the body of water at the location of the structure and a second mode of vibration with a frequency greater than the peak frequency of the spectral wave density profile expected in the body of water at the location of the structure.

46 Claims, 10 Drawing Figures

SPECTRAL ENERGY DENSITY PROFILE OF OCEAN WAVES (STORM WAVE SPECTRUM)

COMPLIANT OFFSHORE STRUCTURE

CROSS-REFERENCE TO RELATED APPLICATION

This application is a continuation-in-part of application Ser. No. 720,035 filed Sept. 2, 1976.

FIELD OF THE INVENTION

The invention relates to a compliant offshore platform which has a limited flexibility in order to move back and forth in a predetermined relationship rather than attempt to remain absolutely rigid in the water. The offshore platform is provided with a first natural period of vibration in excess of the period of a selected collection of waves in a storm-sea state and a second natural period less than the period of the waves of the storm-sea state.

PRIOR ART

Drilling for oil and natural gas has been conducted offshore now for more than three decades. During this time, the petroleum industry has developed many improvements to offshore structures used for offshore drilling and production so that they may accommodate the wind, wave and earthquake forces exerted against them.

One such offshore structure is a relatively rigid one currently planned to be used in water depths as great as 1000 feet. However, such rigid structures must have a large base in addition to over-all rigidity to resist the dynamic amplification of stress. Such amplification of stress requires static design stresses to be magnified so as to simulate the stresses to a structure that occur under complex wind, wave and earthquake forces. In regard to a structure so designed, increased material and handling costs result.

Alternatively, floating platforms anchored to the sea bed by flexible anchor lines may be utilized in deep water. Their initial cost of construction is less than rigid platforms because of the reduction in material which would otherwise be necessary. For example, the legs in a floating platform are several wire ropes instead of large diameter steel legs or built-up columns of a rigid platform. However, difficulty with the connection of risers or pipes extending from the platform to ocean bottom facilities such as wells and pipelines results. A reason for this is the oscillations of such a floating platform cause high stresses in the connections to the well or pipeline that may eventually result in fatigue failure in the connections. The oscillation may result from a steady-sea state as well as from a storm-sea state due to gales, hurricanes, or typhoons.

Another type of floating platform achieves its primary flexibility through utilization of a mechanical hinge or swivel at or near the sea bed. One disadvantage of this type of platform is again the connection of the platform to the ocean bottom facilities. While pipelines and well risers can receive support from the deck of the platform, the section through the area of the hinge undergoes repeated alignment changes as the platform sways with wind and wave forces. These alignment changes require much care and expense to make them leak-proof where pipelines or other flow stream conduits pass through them. Further, these alignment changes of the flow stream conduits also cause fatigue problems that are hard to cope with because the amount of alignment change is uncertain.

Accordingly, the purpose of this invention is to provide a compliant offshore platform that is flexible, yet allows the use of conventional operating methods that have proven successful over the years on rigid offshore structures. Conventional operating methods can be used with the present invention, because the working deck of the compliant platform remains relatively horizontal while its base is affixed to the sea bed, because its support legs flex. For the same reason, this invention allows drilling and completion of the wells at deck level of the platform in the conventional manner. Further, conventional risers and pipelines can be used since the present invention does not have ball joints, hinges or swivel connections at the water bottom.

SUMMARY OF THE INVENTION

The present invention is directed to a compliant platform for use in deep water. The platform comprises a structure including a working deck having a plurality of leg members extendable therefrom in a substantially vertical alignment to position the working deck above a body of water.

The legs are rigidly connected to the working deck and are pinned into the bottom of the seabed.

Horizontal bracing members are rigidly connected between the leg members. Vibration-influencing means are located on the structure to provide the first mode of vibration of the structure with a frequency less than the frequency of the peak of the spectral wave density profile expected in the body of water at the location of the structure and a second mode of vibration of the structure with a frequency greater than the frequency of the peak of the spectral wave density profile expected in the body of water at the location of the structure.

In one aspect, the frequency of the first mode of vibration of the structure is less than one-half the frequency of the peak of the spectral wave density profile expected in the body of water. Further, the structure preferably has a ratio of less than 0.3 between the frequencies of the first and second modes of vibration of the structure.

The vibration-influencing means of the structure of the compliant platform may take many forms. For example, horizontal bracing only may be used. The horizontal bracing may include inwardly tapered portions to lower the frequency of the first mode of vibration of the structure. The vibration-influencing means may also include a stiffening means providing additional stiffness to the leg members at selected levels of the leg members to raise the frequency of the second mode of vibration of the structure. Stiffening means such as vertical diagonal X-bracing are useful to raise the frequency of the second mode. The stiffening means may also take the form of elongated buoyant chambers connected to the exterior of the leg members. The leg members are preferably tubular columns and the upper portions of the tubular columns are smaller in diameter than the diameter of the remaining portions of the tubular columns.

The present invention is directed to a flexible platform that accommodates forces from waves, wind and earthquakes by properly adjusting the frequencies of the natural modes of vibration and/or by elastic deformation or deflection.

The platform has a plurality of substantially vertical leg members pinned to the ocean floor that support a working platform above the water surface. Each leg may have internal pile and well guides. The guides are spaced so that when they are connected to the legs, they increase the shell buckling stability of the legs. Drilling conductor pipe may be used as piling to pin the platform to the ocean floor. The leg members are disposed on the underwater bottom by pinning them rigidly with piles.

The deadweight of the structure and working equipment on the platform is relieved by the use of buoyancy tanks located in the legs and horizontal members. These buoyancy tanks may take the form of enlarged sections at the upper end of the legs and at the joint or connection between the legs and the horizontal members. The buoyancy tanks may also take the form of ballastable sections internal to both the hollow legs and the hollow horizontal members.

The elongated buoyant chambers may be connected at the upper end of the legs so that they are exterior to and extend vertically along the legs between one or more joints formed by the connection of the horizontal members to the legs. Also, shorter buoyant chambers may be connected at one or more of these joints throughout the structure. Either type of buoyant chamber may be formed separately or integrally with the legs. Both types reduce the deadweight of the structure and the moment induced in the legs when they sway horizontally.

PRINCIPAL OBJECT OF THE INVENTION

The principal object of the present invention is to provide a compliant offshore platform having frequencies of the first mode of vibration and the second mode of vibration that straddle the frequency of the peak storm waves expected at the location of the platform so that the platform may flex in the water to better accommodate the wave forces.

Additional objects of the invention will become evident from the following detailed description and the drawings which are made a part of this specification.

DESCRIPTION OF THE PREFERRED EMBODIMENT

Figure 1:
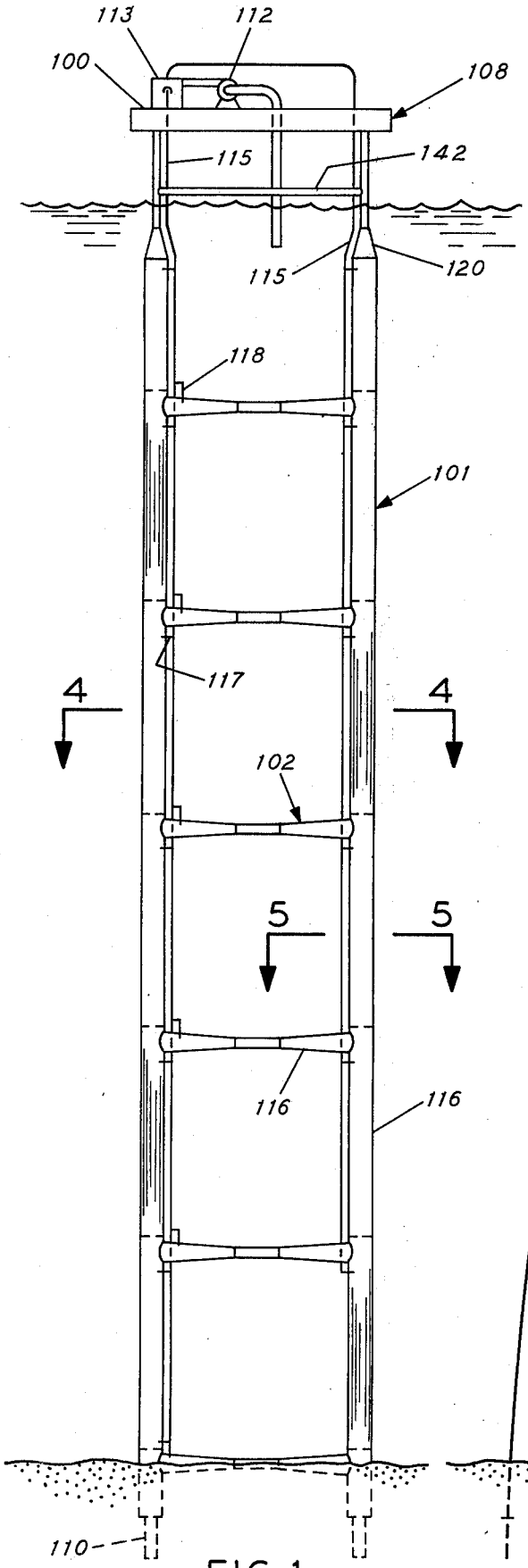
FIG. 1 is an elevation view of the compliant platform.

The compliant platform of the present invention is for use in deep water. As illustrated in FIG. 1, the platform, indicated generally as 108, comprises a structure including a working deck 100 and a plurality of leg members 101 extendable in a substantially vertical alignment from the working deck 100 above a body of water into the bottom of the surface under the body of water. The upper ends of the leg members are rigidly connected to the working deck 100.

Means such as piles 110 are provided for pinning the leg members into the sea floor of the water. Horizontal bracing members 102 are rigidly connected between the leg members. Vibration-influencing means are located on said structure to provide the first mode of vibration of the compliant platform with a frequency less than the frequency of the peak of the spectral wave density profile expected in the body of water at the location of the compliant platform and a second mode of vibration of the compliant platform with a frequency greater than the frequency of the peak of the spectral wave density profile expected in the body of water at the location of the compliant platform.

It is desirable that the ratio between the periods of the first and second modes of vibration be high. Thus it is useful to have vibration-influencing means on the structure for both providing the structure with a ratio less than 0.3 between the frequencies of the first and second modes of vibration of the structure and providing the first mode of vibration of the structure with a frequency less than the frequency of the peak of the spectral wave density profile expected in the body of water at the location of the structure and a second mode of vibration of the structure with a frequency greater than the frequency of the peak of the spectral wave density profile expected in the body of water at the location of the structure. The use of only horizontal bracing over most of the height of the legs has a major effect on providing the desired long period of the first mode of vibration. Inwardly tapering horizontal bracing adds to this effect. The short period desirable for the second mode of vibration is promoted by the use of stiffening means, such as X-bracing or elongated buoyancy chambers connected to the structure at appropriate levels of the legs to shorten the second-mode period. The period of the first mode of vibration should be in excess of 25 seconds. Preferably the period of the first mode of vibration should be in the range of from 40 seconds to 60 seconds. The period of the second mode of vibration should be less than 12 seconds, and preferably in the range of from 9 to 12 seconds. In any event, the ratio of the period of the first mode to the period of the second mode should be at least 3.3.

The offshore platform adaptable to be floated and subsequently pinned to the floor of a body of water is shown in FIGS. 1, 3, 8 and 9. The platform has a working deck 100 located above the body of water. The deck remains relatively horizontal when the platform of FIGS. 1, 3, 8 and 9 sways due to external forces such as wind or wave forces (see FIG. 2). Deck 100 has sufficient rigidity to prevent excessive distortion when the platform sways, that is, the deck remains relatively flat.

The compliant platform 108 comprises a structure which includes, besides deck 100, a plurality of at least three elongated support legs 101. Four legs, for example, are illustrated in FIGS. 1, 3, 4, 8 and 9. The legs extend from the working deck to the water bottom where they are pinned to it by piles 110. A cross-section of a typical leg having pile-guiding means 103 that may also serve as guides for the drilling string is shown in FIG. 5.

Figures 6, 7:
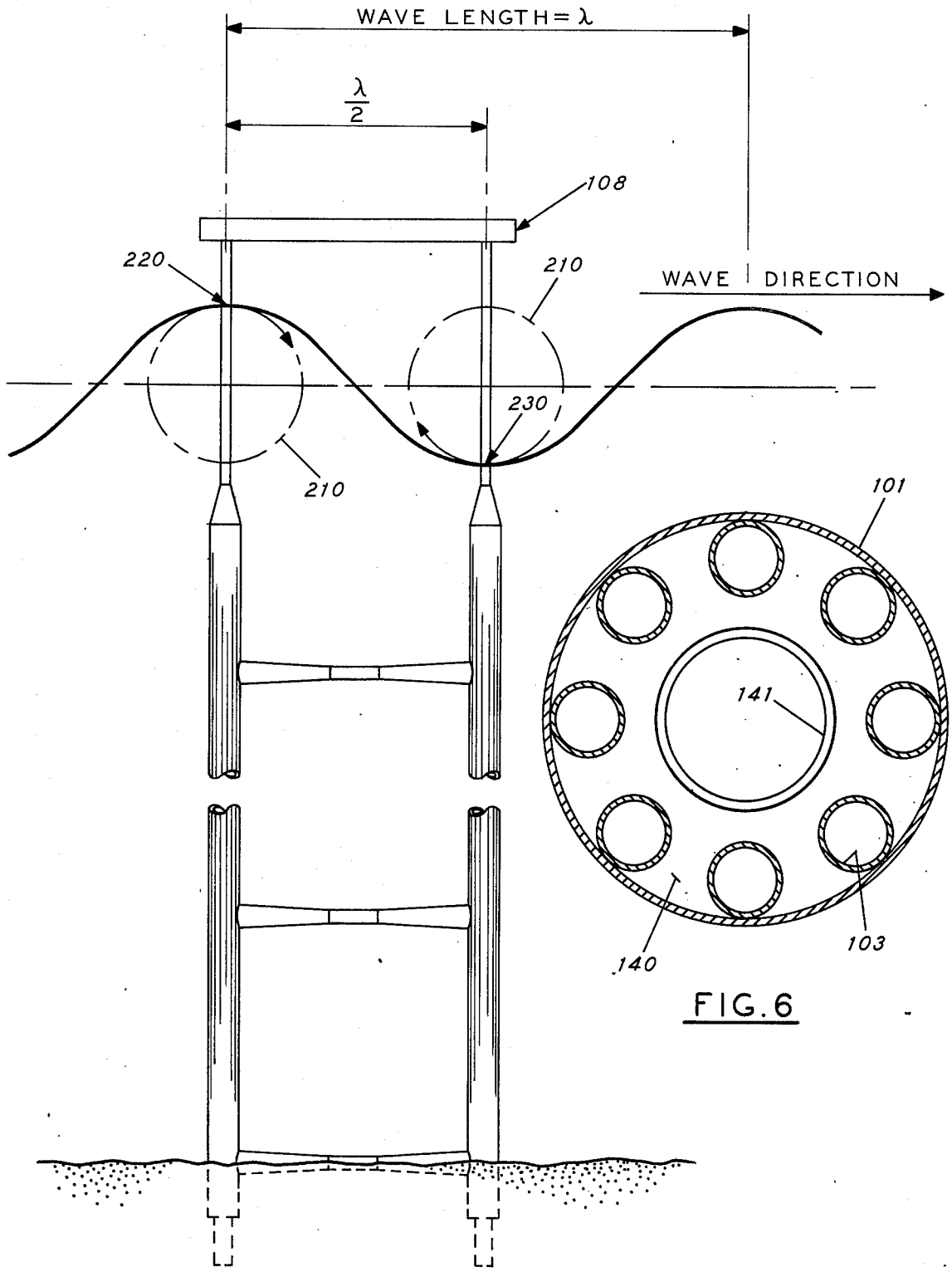
FIG. 6 is another typical cross-section illustrating another embodiment of pile-guiding means.
FIG. 7 is a schematic elevation view illustrating the self-cancelling effect of water particle orbits in a wave component on the legs of the compliant platform.

Pile guiding means or conductor 103 is held in place by several longitudinal plates 105 that may run the full length of leg 101 and are welded or otherwise secured to the interior surface of the leg and conductor guide 103. In the space between guide 103 and plate 105, a filler material 104 (which has a crushing strength of about 500 psi) can be provided. As mentioned, these guides are spaced so that they increase the shell-buckling stability of the legs. Another form of pile guiding means is, for example as illustrated in FIG. 6, a ring stiffener 140 with flange 141 having holes through which conductor guides 103 are connected. These two types of stiffeners may be used interchangeably or together. Additional internal shell stiffening may be required if the guides are not rigidly attached to the legs.

Figure 3:
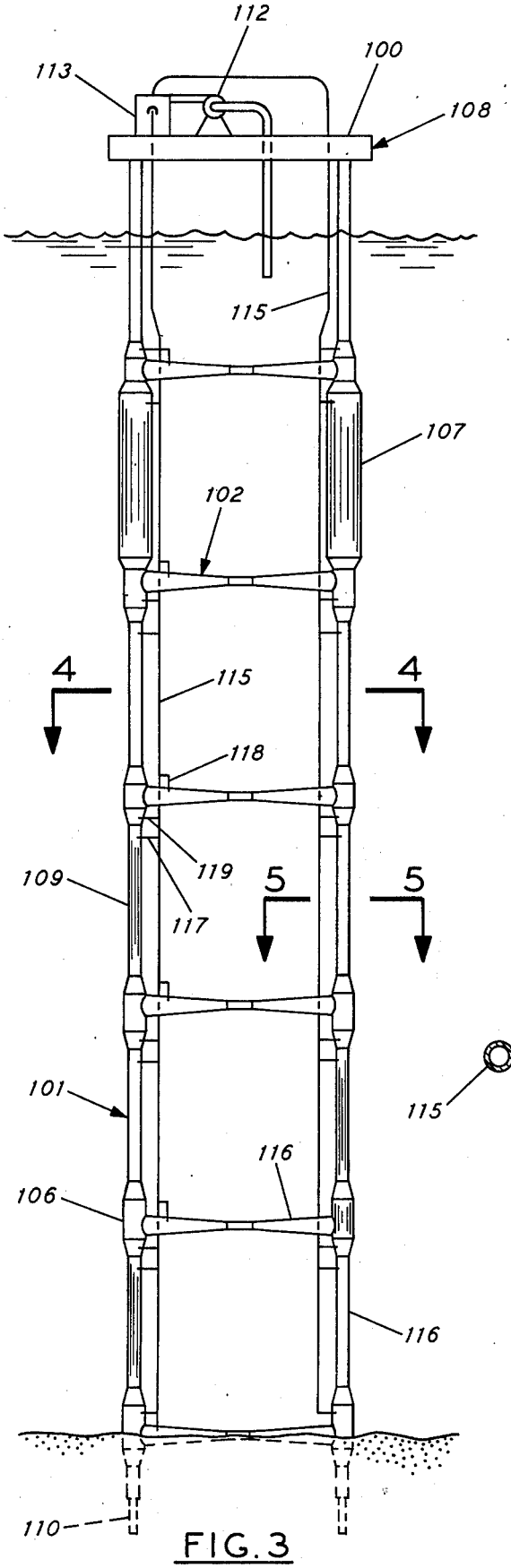
FIG. 3 is an elevation view of an alternate embodiment of the invention and illustrates enlarged buoyancy chambers forming the upper portion of the platform legs.
Figure 4:
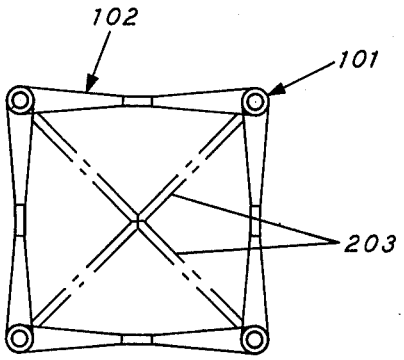
FIG. 4 is a typical cross-section of the platform taken at section line 4—4 of FIGS. 1, 3, 7 and 8, showing horizontal bracing which may be present in phantom.
Figure 5:
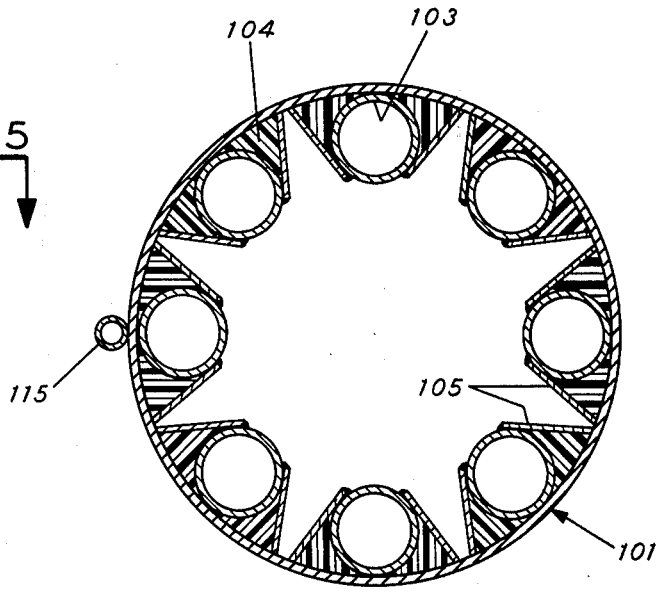
FIG. 5 is a typical cross-section taken at line 5—5 of a leg member of the platform and illustrates one embodiment of the guiding means.

FIG. 4 shows a typical sectional view of the various embodiments disclosed herein. It illustrates the shape of the horizontal members 102 and horizontal diagonals 203 that may be connected in selected planes of horizontal members 102. The horizontal bracing provides torsional restraint as well as keeping the action of the vertical legs in unison when the platform sways. Horizontal members 102 may form the sole underwater connection between the legs for the platform in FIGS. 1 and 3. Or, as in FIGS. 8 and 9, they form the underwater connection between the legs for most of their length. The connection of the horizontal members to the legs is such that each set of members 102 is in one horizontal plane, i.e., coplanar, when the platform is undeflected. The horizontal members may have varying cross-sections along their length with a correspondingly varying moment of inertia. The bottom or lowermost horizontal member should be very stiff compared to the other horizontal members. Thus, the bottom horizontal member is preferably not tapered and generally should be in excess of twice the diameter of the other horizontal members measured at their largest cross-section.

More specifically, the horizontal members can be symmetrically and inwardly tapered, so that the beam depth — and in some cases beam width — and moment of inertia are greater at points where the bending moment is larger. Thus, the cross-section varies to provide an approximately uniform bending stress along the outer fibers of the member. Alternatively, they can be made from higher strengths of steel: allowing for smaller, more flexible members and higher stresses (and therefore greater strains) to provide large deflections, or they can be a composite of the above.

Figure 2:
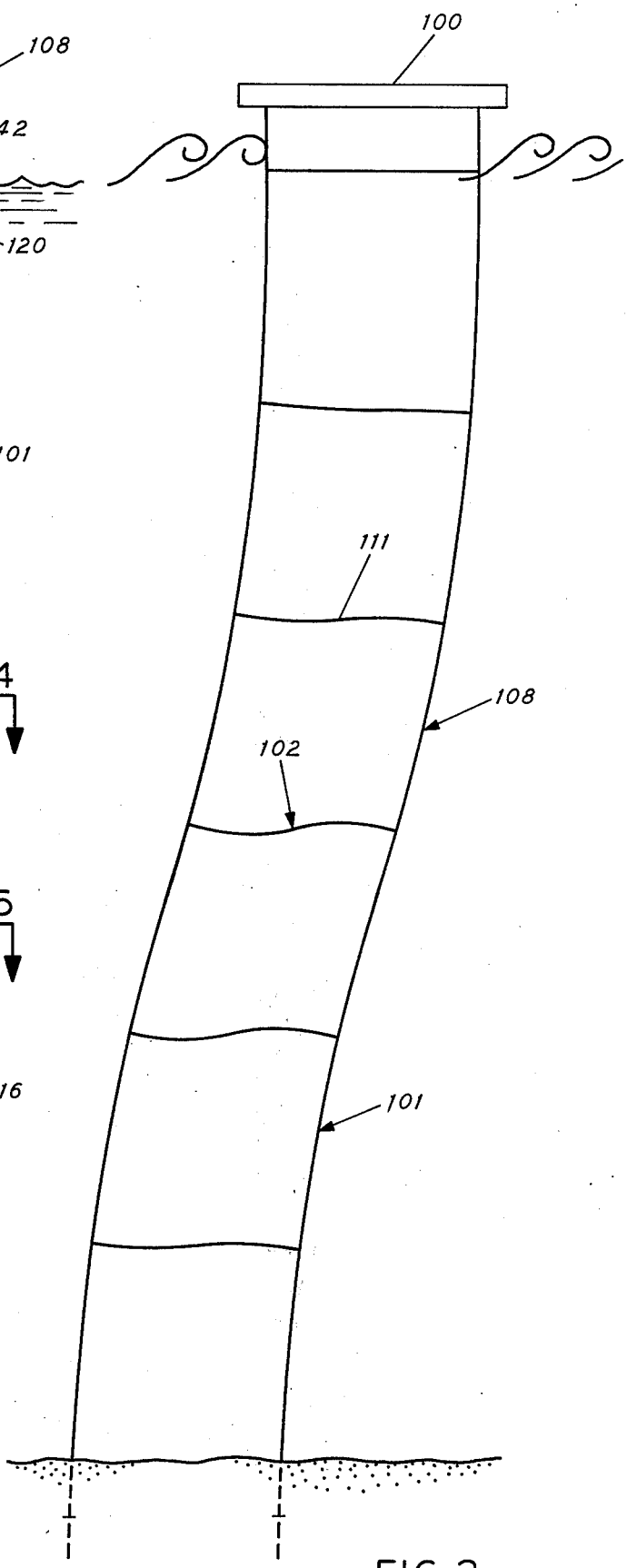
FIG. 2 is a schematic elevation outline of the platform illustrated in FIG. 1 in a flexed position.

In deflected shape, the horizontal members have a point of counterflexure or inflection due to live load moments, at approximately their midspan (111, FIG. 2). As known in the art, a point of inflection or counterflexure is a location on a structural member where the bending of the member changes from one character to another — that is, the curvature of the member reverses at the location.

Also to aid in keeping the deck 100 relatively horizontal when the legs are deflected, the upper end of the legs 101 can be tapered, reducing in diameter at their upper ends 120, to allow the working deck to remain horizontal owing to the reduced moment of inertia of the legs and their corresponding reduced stiffness. Thus, the ratio of the stiffness ($Kp$) of the working deck 100 to the stiffness ($Kl$) of the adjacent legs 101 is high.

Each of the support legs 101 and the horizontal members 102 is preferably made from hollow tubular members so that its interior can be partitioned off into ballast tanks or chambers 116. These tanks are then flooded (ballasted) or emptied (deballasted) as desired to provide sufficient mass to the entire platform 108 so as to vary the natural modes of vibration of the platform so that at least the frequency of one of them is out of phase with the frequency of some of the water waves around it. They are — with or without the buoyancy chambers 106 and 107 of FIG. 3 — means for varying the mass of platform 108.

This feature of varying the mass of the platform allows the platform's frequency to be tuned to avoid the frequency of some of the waves forecast against it. Consequently, dynamic amplification of the design stress, as a result of being at or near resonance of the frequency of water waves around it, is significantly reduced. Additionally, the varying mass of the tubular support legs (varying with both the amount of ballast in the legs and weight of the legs) can assist in locating the platform.

The present invention is directed to a flexible platform that accommodates forces from waves, wind and earthquakes by properly adjusting the frequencies of the natural modes of vibration and/or by elastic deformation or deflection.

The platform has a plurality of substantially vertical leg members pinned to the ocean floor that support a working platform above the water surface. Each leg may have internal pile and well guides. The guides are spaced so that when they are connected to the legs, they increase the shell buckling stability of the legs. Drilling conductor pipe may be used as piling to pin the platform to the ocean floor. The leg members are disposed on the underwater bottom by pinning them rigidly with piles. The legs may also be pinned to the sea floor by other means such as, for example, a ballasted mat.

The deadweight of the structure and working equipment on the platform is relieved by the use of buoyancy tanks located in the legs and horizontal members. These buoyancy tanks may take the form of enlarged sections at the upper end of the legs and at the joint or connection between the legs and the horizontal members. The buoyancy tanks may also take the form of ballastable sections internal to both the hollow legs and the hollow horizontal members.

Several advantages result from the use of buoyancy tanks and enlarged hollow legs. First, the material requirements of the foundation are less since a portion of the deadweight is supported by the platform's over-all buoyancy. Second, the moment in the columns and horizontal members that results from a large eccentricity due to the sway of the flexible compliant platform is minimized especially by the enlarged buoyancy sections at the upper end of the leg. Third, the ballast tanks throughout the leg members can be filled or emptied to tune (or adjust) the frequency of at least one of the natural modes of vibration of the platform so that it is out of phase with a wave frequency encountered in the area the platform is located.

Certain terms such as "frequency," "degrees of freedom," and the like, which are used herein will now be defined. The frequency of the platform is the number of vibrations or oscillations (round trips or excursions of the platform from one extreme displacement (amplitude) to another and back per unit time). It is the reciprocal of the period — the time required for one vibration. The degrees of freedom are the number of coordinate points necessary to define the position of the platform at any time during an oscillation. It is further noted here that the offshore platform has as many natural modes of vibration as degrees of freedom, all of which have a distinct shape, each having its own natural frequency of vibration. The natural frequency is the frequency of the platform after being placed into motion — but without a continuing exciting force. When a continuing exciting force system — such as waves — is introduced, a forced frequency of vibration of the platform results. When the natural frequency and forced frequency are identical or nearly so, resonance occurs and the dynamic effect on the platform may become critical.

Flexibility of the platform may be achieved in several ways. They are: varying the modulus of elasticity of structural material, varying the moment of inertia of structural components, and varying the yield strength of the structural material. Primary flexibility is also provided by the general lack of vertical diagonal members. Ideally, the combination of the structural material and configuration should be such that the outer fiber stress is relatively or substantially uniform over the horizontal member length.

Pursuant to the invention, a method is also provided for reducing the dynamic amplification of stress on a flexible platform by accommodating large horizontal periodic forces. This is made possible by constructing a rigid deck locatable above a body of water and connecting a plurality of ballastable support legs at their upper end to the deck. To reduce the total force on the platform, the legs are spaced so that each leg is a half-wavelength apart from another, as illustrated, for example, in FIG. 7. The half-wavelength is based on a wave component of the wave spectrum that has a period equal to at least one of the frequencies of the natural mode of vibration of the structure. Since the water particles of such a wave component rotate in an assumed clockwise orbit, they rotate from right to left at the wave crest, while at the wave trough they rotate from left to right against a second set of legs. In effect, the force of this wave component is self-cancelling on the platform.

Connected to the legs are horizontal ballastable members with a varying cross-section. Such a cross-section provides uniform bending stress along the outer fibers of nearly the entire length of the horizontal mmbers. They are connected in a plurality of coplanar sets (as determined when the platform is in an undeflected position). The sets are spaced a predetermined distance from one another along the vertical length of the legs. Both the legs and horizontal members are flooded or left void to provide proper mass to the flexible compliant platform in order to vary the frequency of the natural modes of the vibration of the flexible platform so that at least the first and second modes are out of phase with the frequency of the maximum energy of a storm wave spectrum for the vicinity where the platform is to be located.

Figure 10:
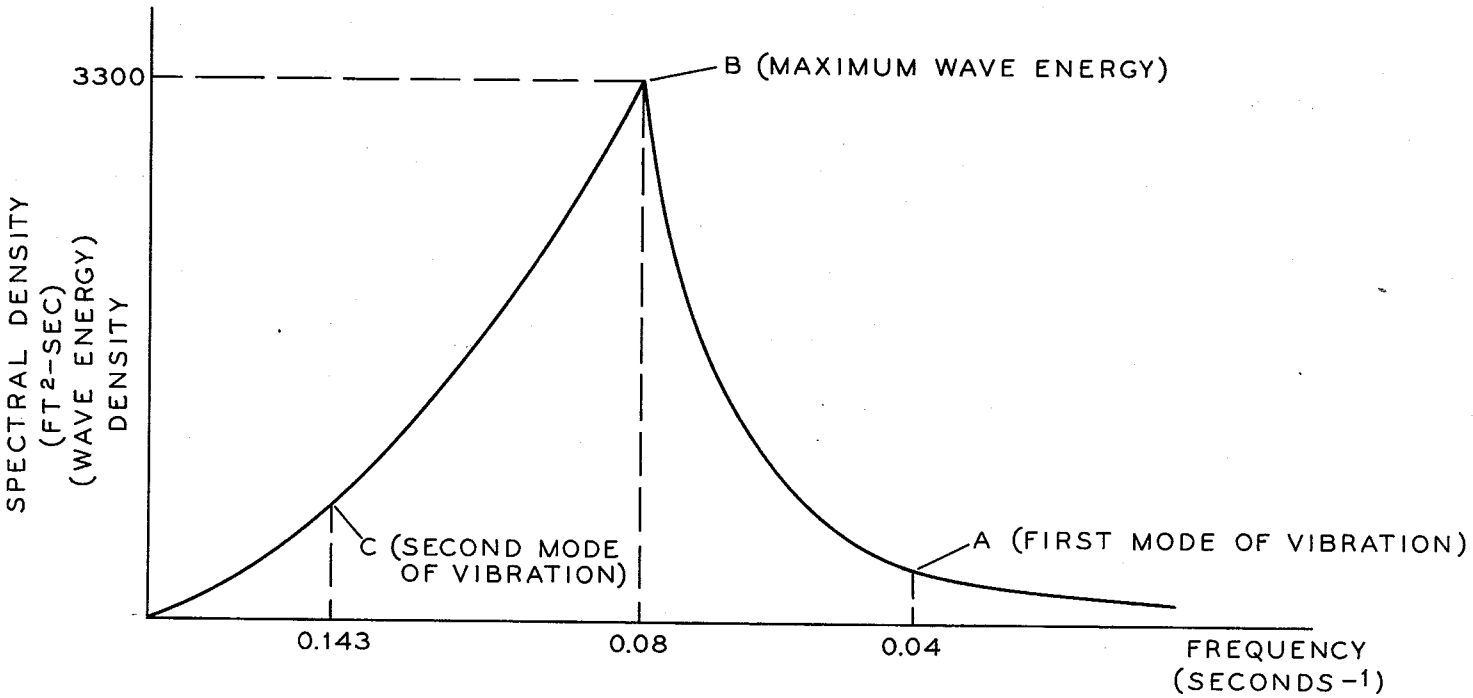
FIG. 10 is a graph illustrating a typical wave spectrum known as a spectral energy density profile of ocean waves.

To comprehend the importance of straddling the period or frequency of the maximum wave energy, it is helpful here to review the basics of a wave spectrum, which is illustrated in FIG. 10. "Wave spectrum" is a term used to describe the distribution of the wave energy present in a wave system with respect to wave period or frequency. In FIG. 10, the wave energy is plotted along the Y-axis (axis of coordinates) in $ft^2$-sec and the frequency is plotted along the X-axis (axis of abscissa) in $seconds^{-1}$. This graph is also referred to as spectral density of the ocean waves. The words "wave system" refer to a combination of a series of wave components of different periods or frequencies and wave heights which, of course, have corresponding components of energy. The wave spectrum or spectral energy density profile is proportional to the square of the wave height associated with the frequency of a particular component of a wave system. Thus the total area under the graph of a wave spectrum or spectral density function is proportional to mean wave energy per unit of projected area of sea surface.

For the purpose of reducing the dynamic amplification of design stress due to platform oscillation, it is advantageous to place the legs of the platform so that their spacing is equivalent to one-half the wavelength of a wave which has a period equal to the second or higher order mode of vibration of the platform. This will cancel the forces imposed by the energy of the selected frequency contained in the spectral energy density profile of the waves. These higher order modes of vibration have short periods which can be reasonably matched with short half lengths of the spectral energy component of that frequency from the wave train. By matching leg spacing to these short half-wavelengths, resonant vibrations in the selected higher mode of vibration are greatly reduced. The reason for this result is that the water particles of this wave component rotate in an orbit 210, FIG. 7, which, when assumed in a clockwise direction, rotate right to left at the wave crest 220, where a first set of legs may be located, and from left to right at the wave trough 230 where a second set of legs may be located. It is again noted that these higher order modes of platform vibration have short periods making it possible to have leg spacing substantially equivalent to the half-wavelength of this wave component. This leg spacing also eliminates platform resonance with the selected wave component frequency. Of course the platform must be designed using dynamic analysis techniques to withstand other components of the wave system having different wavelengths which are not self-cancelling.

FIG. 3 illustrates the compliant platform 108 or, as some may call it, "marine offshore tower" or "flexible platform for deep water," with a slightly different configuration. This platform has a plurality of symmetrically and inwardly tapered horizontal and ballastable members 102 vertically spaced a predetermined distance apart, for example, a distance which increases the buckling stability of the legs. The horizontal members are connected to leg supports or legs 101 to form a joint. The horizontal members are constructed so that the outer fiber bending stress throughout the length of the horizontal is substantially uniform. Also illustrated in FIG. 3 is a shortened, controllably buoyant container or chamber 106 about each joint. Located in the vicinity of the upper end of the legs and extending vertically over the legs between two or more joints are elongated, controllably buoyant containers or chambers 107.

These buoyancy chambers are advantageous for positioning the platform on the floor of the body of water because, by varying the ballast in them, for instance by introducing water into them, the mass of the structure 108 is changed. Another advantage is the vertical support they provide due to their controllable buoyancy.

Yet another advantage equally as important is that they reduce the moment in the leg owing to the eccentricity each leg develops as the platform sways. As a result, the foundation for the structure can be less expensive due to the smaller number of piles 110 required to keep the structure pinned to the ocean floor.

The ballasting (flooding) and deballasting (emptying) of members 101 and 102, FIGS. 1 and 3, and buoyancy chambers 106 and 107 of FIG. 3 to vary the mass of the legs are controlled by conduits 115 located adjacent to or within each leg with inlets 117, 118 and 119. These inlets are respectively connected to each chamber. Conduit 115 is connected to a manifold 113 located on deck 100 which in turn is connected to a pump 112. The pump moves water from the sea surrounding the structure 108 through the manifold 113 to conduit 115. Another system (not illustrated) locatable near the bottom of the structure can be used to empty or blow out members 101, 102 and chamber 106, 107. The compliant platform should have a degree of buoyancy to provide for at least some tension at the bottom of the legs.

A platform has been disclosed which through its elastic deflections reduces the dynamic amplification of the design stress. The amplification factor of static design stress to dynamic design stress may be less than one. And as discussed, the platform may have its legs spaced a half wavelength apart of a wave component of a wave spectrum whose frequency is equal to the frequency of one of the natural higher order modes of vibration of the structure so as to further reduce the dynamic amplification of design stresses.

In FIG. 10 a graph represents the response of the platform whose frequency of the first mode (point A, FIG. 10) and second mode (point C, FIG. 10) straddles the frequency (point B, FIG. 10) at which the peak energy of a storm wave spectrum occurs. The significance of this is that the frequency of the first mode of the platform (point A) is out of phase with the frequency of the storm wave components (point B) that form a storm wave spectrum. The wave forces therefore are not magnified through resonance of the platform's frequency and the frequency of the maximum wave energy. Further, the frequency of the platform's second mode (point C, FIG. 10) is out of resonance with waves of higher frequency that are commonly experienced for a given area when a storm is not present, which is also above the frequency of the maximum wave energy of the storm wave spectrum. This is significant because the waves of shorter period are generally more frequent and thus cause fatigue.

As illustrated in FIG. 10, the frequency of the platform's first mode of vibration A is 0.04 seconds$^{-1}$ or a period of 25 seconds. The frequency of the platform's second mode of vibration B is 0.143 seconds$^{-1}$ or a period of 7 seconds. The frequency of the peak B of the spectal energy density profile is 0.08 seconds$^{-1}$ or a period of 12.5 seconds. The ratio of the periods of the first and second modes should be high. Thus it is desirable to have the ratio of the first and second mode period have a value of at least 3.5, or conversely the ratio of the first and second mode frequencies should have a value of less than 0.3. In preferred form the frequency of the first mode of vibration is at most one-half the frequency of the peak of the spectral wave density profile, or conversely the period of the first mode is twice the period of the peak of the spectral wave density profile.

Figure 8:
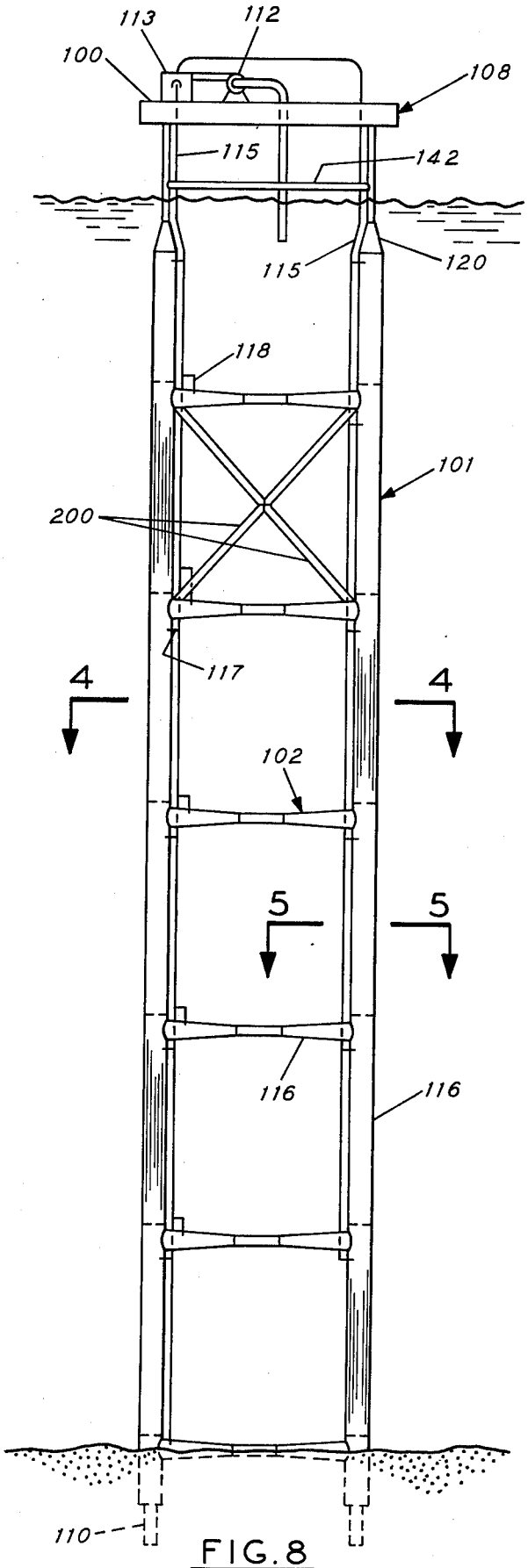
FIG. 8 is an elevation view and illustrates an alternate embodiment of the invention which includes a stiffened upper portion.

The platform with a second-mode frequency out of phase with waves of a shorter period commonly experienced for a given area when a storm is not present is illustrated in FIG. 8. By vibrational analysis of this platform, it was found that dynamic amplification is reduced because the frequency of the first mode, as already mentioned, indicated by point A (FIG. 10) is to the right of the frequency of the maximum energy, indicated by point B. And the frequency of the second mode (point C) is to the left of the frequency of the maximum energy (point B). The embodiment in FIG. 8 accomplishes this result through the platform flexibility and the additional stiffness provided at a selected level — symbolically represented by X-bracing 200.

Figure 9:
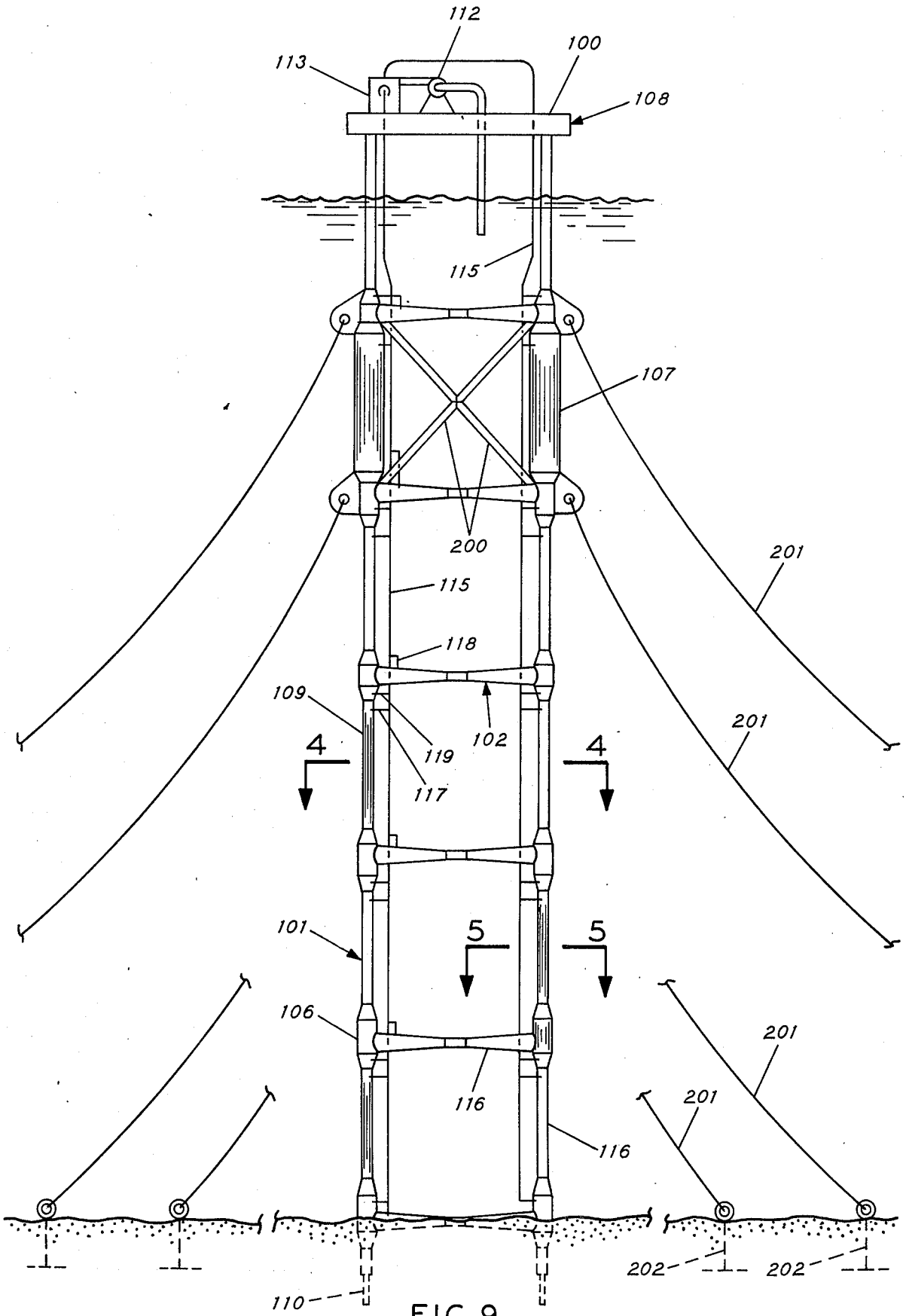
FIG. 9 is an elevation view and illustrates a further alternate embodiment of the invention including guy lines connected to its upper portion to limit the motion of the platform during unprecedented storm waves and also changes the relative frequencies of first and second modes of vibration.

Before passing on to a description of FIG. 9, it is noted that the platform of FIG. 8 (as well as FIG. 1 already described) has a boat loading ramp access generally indicated by numeral 142. The ramp is provided for access to the platform and may be eliminated or modified to suit the local conditions where the platform is located.

Now turning to FIG. 9, guy lines (wires) 201 are connected to the upper end of the platform. Two guy lines are indicated as being attached to each leg — although more or less may be used as required. They are provided as a safety feature in order to limit movement of the upper portion of the structure in large or unprecedented storm waves. The restraint from the guy lines is not to be so great as to limit the structure's flexibility in normally anticipated storm waves. These lines are secured to the subsea bottom by anchors 202 or otherwise weighted down.

The foregoing describes selected embodiments of the present invention in detail. The invention, however, is not to be limited to any specific embodiment, but rather only by the scope of the appended claims.

What is claimed is:

1. A marine structure for supporting sundry equipment, said structure comprising:

a deck having sufficient stiffness to remain relatively horizontal when said deck sways due to wind and wave forces against said marine structure;

a plurality of elongated tubular support legs in a spaced relationship from each other extending from said deck to the floor of said body of water, said legs being hollow and reducing in diameter at the upper end of said legs whereby said legs have reduced moment of inertia and in turn a reduced section modulus so as to have a high ratio of deck stiffness to the stiffness of the adjacent leg members, whereby said deck remains relatively horizontal;

a plurality of sets of horizontal members, wherein each of said horizontal members is connected to said legs so that each of said sets is in one horizontal plane when said structure is undeflected;

said horizontal members having a varying cross-section and a corresponding moment of inertia which allows said deck to horizontally sway so as to reduce the dynamic amplification of design stress.

2. A marine structure adapted to be floated to and subsequently embedded into the floor of a body of water for supporting sundry equipment, said structure comprising:

a working deck having sufficient stiffness to remain relatively horizontal when said working deck sways due to wind and wave forces against said marine structure;

a plurality of elongated tubular support legs in a spaced relationship from each other extending from said working deck to the floor of said body of water, said legs being hollow and reducing in diameter at the upper end of said legs so as to have a high ratio of working deck stiffness to the stiffness of the adjacent leg members so that said working deck remains relatively horizontal;

a plurality of sets of horizontal members, wherein each of said horizontal members is connected to said legs so that each of said sets is in one horizontal plane when said structure is undeflected;

said horizontal members having a varying cross-section and a corresponding moment of inertia which allows said working deck to horizontally sway so as to reduce the dynamic amplification of design stress and in turn material costs; and guy lines slackly conntected between the upper portion of said legs and the floor of the body of water to permit said working deck to horizontally sway during normally anticipated storms and to limit the horizontal sway of said working deck during unprecedented storms.

3. An offshore tower adapted to be pinned to the bed of a body of water with an upper portion thereof extending above the surface of the body of water for supporting a rigid platform, said tower comprising:

a plurality of tower legs extending from a rigid platform to the bed of a body of water, said legs disposed about a vertical axis of said tower and each leg characterized by a varying moment of inertia along its length so that a reduced stiffness occurs at the upper end of each leg having a high platform to leg stiffness ratio to allow said rigid platform to remain horizontal;

a plurality of coplanar horizontal members interconnecting said tower legs, each of said horizontal members having a configuration which allows said horizontal members to have a point of contraflexure at midspan of said horizontal member;

whereby the resulting flexibility from said horizontal members in combination with the rigid platform keeps said platform horizontal while the upper end of said legs of said tower are horizontally displaced due to an external force.

4. An offshore structure that can significantly sway horizontally without destructive results, comprising:

a deck above the water surface having sufficient rigidity to remain relatively horizontal, as said offshore structure sways;

at least three support members having adequate strength to support said deck while at the same time swaying horizontally due to the forces of a storm wave while allowing said deck to remain relatively horizontal, said support members having a first set of ballast chambers on predetermined locations of said support members so as to adjust the buoyancy of said structure when said structure is being located and to vary the mass and the natural modes of vibration of said offshore structure by selective addition and deletion of ballast in said first set of ballast chambers when connected to the water bottom;

a plurality of sets of horizontal members, each set respectively interconnecting each of said support legs at predetermined intervals along said vertical members;

said horizontal members forming the sole underwater connection between said vertical members;

a second set of ballast chambers within said horizontal members for varying the natural modes of vibration of said offshore structure by selective addition and deletion of ballast in said second set of ballast chambers; and means for varying ballast in said first and second sets of ballast chambers for the purpose of varying the buoyancy and natural modes of vibration of said offshore structure.

5. A flexible offshore platform, without structural diagonal members in its vertical plane, that accommodates horizontal deflections due to external forces, comprising:

a working deck of sufficient rigidity to prevent excess distortion of said deck due to wind and wave forces transmitted to said platform so that said deck remains relatively flat;

a plurality of tubular support leg members connected to said deck and extending to the water bottom;

a plurality of sets of coplanar horizontal tubular members interconnecting said support leg members, each of said horizontal members constructed to have a substantially uniform bending stress along the outer fibers of said horizontal member; and means for introducing water into said tubular support leg members and said horizontal tubular members.

6. A flexible platform for deep water, comprising:

a rigid deck that remains relatively horizontal when said platform is displaced laterally by external forces;

a plurality of ballastable legs to support said deck, each of said legs connected at one end to said deck and pinned at the other end to the subsea bottom, said legs spaced a half wavelength apart wherein said half wavelength is based on a wave component of a wave spectrum, said wave component having a frequency which corresponds to the frequency of one of the natural modes of vibration of said platform;

a plurality of symmetrically and inwardly tapered horizontal and ballastable members, said horizontal members vertically spaced a predetermined distance from each other and connected to said leg supports to form a joint, said horizontal members constructed so that the outer fiber bending stress throughout the length of said horizontal members is substantially equal;

a plurality of elongated controllably buoyant means connected to said legs wherein each elongated means is respectively located in the vicinity of the upper end of said legs, and extends vertically over each of said legs between a plurality of said joints;

a plurality of shortened controllably buoyant means, each means located respectively about each joint of the horizontal member and leg supports;

means for varying ballast in said legs, said horizontal members, said elongated buoyant means and said shortened buoyant means; and pile-guide means located and secured within each of said leg supports to guide drilling means and increase shell-buckling resistance of said legs.

7. A flexible offshore platform, without structural diagonal members in its vertical plane, that accommodates horizontal deflections due to external forces, comprising:

a working deck of sufficient rigidity to prevent excess distortion of said deck due to wind and wave forces transmitted to said platform so that said deck remains relatively flat;

a plurality of tubular support leg members connected to said deck and extending to the water bottom;

a plurality of sets of coplanar horizontal tubular members interconnecting said support leg members, each of said horizontal members constructed to have a substantially uniform bending stress along the outer fibers of said horizontal member;

means for introducing water into said tubular support leg members and said horizontal tubular members; and horizontal bracing in the plane of selected sets of said horizontal members, said bracing connected in the vicinity of the connections between said selected sets of horizontal members and said support leg members.

8. A flexible offshore structure that accommodates forces due to wind, waves and earthquake by elastically deflecting and further reducing the effect of said forces on said structure by having a natural mode of vibration which has first and second mode frequencies which straddle the frequency of the maximum energy of a storm wave spectrum, said structure comprising:

a rigid work deck locatable above the water surface;

plurality of support legs to support said deck, said support legs connected at one end to said deck and the other end located at the water bottom;

a plurality of horizontal members interconnecting said plurality of support legs, said horizontal members so spaced to form a frame member made up of two horizontal members interconnecting portions of said support legs at predetermined locations along each of said support legs;

a stiffened frame in said structure located at selected locations near the upper end of said support legs, so that the frequency of the first and second mode of said structure straddle the frequency of the maximum wave energy of the storm wave spectrum.

9. A flexible offshore structure of claim 8 wherein said support legs and said horizontal members are ballastable to facilitate locating the structure at an offshore location and adjusting the natural modes of vibration so that their frequencies are out of phase with the frequency of the maximum wave energy of said storm wave spectrum and wherein said stiffened frame comprises vertical X-bracing and means for varying the ballast in said support legs and horizontal members.

10. A flexible offshore structure that reduces the dynamic amplification of design stress by adjusting the frequency of the first and second modes of vibration, said structure comprising:

a rigid deck locatable above the water surface for supporting equipment;

ballastable vertical support members connected at the upper end to said deck and pinned to the subsea water bottom;

a plurality of sets of horizontal members, wherein each of said horizontal members is respectively connected to said legs to form a connection so that each of said sets is in one horizontal plane when said structure is undeflected;

a plurality of elongated controllably buoyant means connected to said platform wherein each elongated means is respectively located in the vicinity of the upper end of said vertical support members, and extends vertically over each of said vertical support members between a plurality of said connections, said elongated controllably buoyant means used to aid in reducing the moment in the vertical support members and horizontal members resulting from eccentricity due to the sway of said flexible offshore structure, and further to reduce the deadweight of the structure;

a plurality of shortened controllably buoyant means, each of said shortened buoyant means located respectively about each connection of the horizontal member and vertical support members;

means for varying the ballast in said vertical and horizontal members, said plurality of elongated controllably buoyant means, and said plurality of shortened controllably buoyant means;

pile-guide means located and secured within each of said legs to guide drilling means and increase shell-buckling stability;

means for stiffening the upper portion of said structure so that the frequency of the first and second modes of vibration of said offshore structure straddle the frequency of the maximum wave energy of a storm wave spectrum so that the dynamic effect of external forces is reduced.

11. A flexible offshore structure that reduces the dynamic amplification of design stress by adjusting the frequency of the first and second modes of vibration, said structure comprising:

a rigid deck locatable above the water surface for supporting equipment;

ballastable vertical support members connected at the upper end to said deck and pinned to the subsea water bottom;

a plurality of sets of ballastable horizontal members, wherein each of said horizontal members is respectively connected to said vertical support members to form a connection so that each of said sets is in one horizontal plane when said structure is undeflected;

a plurality of elongated controllably buoyant means connected to said platform wherein each elongated means is respectively located in the vicinity of the upper end of said vertical support members, and extends vertically over each of said leg supports between a plurality of said connections, said elongated controllably buoyant means used to aid in reducing the moment in the vertical support members and horizontal members resulting from eccentricity due to the sway of said flexible offshore structure, and further to reduce the deadweight of the structure;

a plurality of shortened controllably buoyant means, each of said shortened buoyant means located respectively about each connection of the horizontal member and vertical support member;

means for varying ballast in said vertical support members, horizontal members, elongated controllably buoyant means and shortened controllably buoyant means;

pile-guide means located and secured within each of said legs to guide drilling means and increase shell-buckling stability;

means for stiffening the upper portion of said structure so that the frequency of the first and second modes of vibration of said offshore structure straddle the frequency of the maximum wave energy of a storm wave spectrum so that the dynamic effect of external forces is reduced; and horizontal bracing in the plane of selected sets of horizontal members and connected in the vicinity of said horizontal member and leg connection.

12. A flexible offshore structure that reduces the dynamic amplification of design stress by adjusting the frequencies of the first and second modes of vibration, of claim 11 further comprising:

guy lines slackly connected between the upper portion of said platform and to the floor of a body of water to permit said deck to horizontally sway during normally anticipated storms and to limit horizontal sway of said deck during unprecedented storms.

13. A method for accommodating large horizontal forces on a flexible platform for water depths in the range of 500 to 2,000 feet resulting from wind and wave forces, comprising:

positioning a rigid deck above a body of water;

extending a plurality of ballastable support legs between the underwater bottom and working platform;

rigidly connecting said ballastable support legs to said working deck at the upper end of said legs;

rigidly connecting a plurality of horizontal ballastable members at spaced points along said legs, each of said horizontal members having a varying cross-section to provide uniform bending stress along the outer fibers of said horizontal member's entire length;

connecting said horizontal members to said legs in a plurality of sets spaced a predetermined distance between each set of horizontal members along the vertical lengths of said legs, so that said sets of horizontal members from the sole underwater connection between said legs;

pinning said legs on the bottom of a body of water so that said legs, without the use of swivels and hinges, allow said platform to flex horizontally; and flooding at least portions of said legs and said horizontal members to provide sufficient mass to said flexible platform so as to vary the natural modes of vibration of said flexible platform, so at least the frequency of one of the natural modes is out of phase with the frequency of some of the water waves in the vicinity of said flexible platform.

14. A method for reducing the dynamic amplification of stress on a flexible platform due to oscillation so as to reduce material costs, wherein said platform is pinned to the underwater bottom of a body of water, comprising forming a rigid working deck;

connecting a plurality of legs having internal partitions forming ballast chambers to said working deck so that a first one of said plurality of legs is a half-wavelength apart from a second one of said plurality of legs, wherein said half wavelength is that of a wave component of a spectral energy density profile which has a period equal to a second or higher order mode of vibration of said platform, whereby the wave spectral energy of said wave component on the platform cancels itself because the water particles of said wave component against a first one of said legs rotate in an assumed clockwise orbit from right to left at the wave component's crest, while at the wave component's trough, the water particles of said wave component rotate from left to right against a second one of said legs;

connecting horizontal, tapered members, which have a varying cross-section to provide substantially uniform bending stress along the length of said member, each of said horizontal members having compartments forming ballast chambers, to said legs so that when said horizontal members are connected they form coplanar sets of horizontal members when said legs are in an undeflected position, and wherein said sets of horizontal members are spaced a predetermined interval from each other;

disposing said legs on the underwater bottom so that the rigid deck can flex horizontally without the use of swivels and hinges; and ballasting said legs and horizontal members so as to vary the natural modes of vibration of said flexible platform so at least the frequency of one of the natural modes is out of phase with the frequency of some of the water waves in the vicinity of said flexible platform whereby the dynamic amplification of the design stress is reduced.

15. A method of claim 14 for reducing the dynamic amplification of design stress of a flexible platform due to oscillation so as to reduce material costs comprising:

stiffening the upper portion of said flexible platform so that the frequencies of the first and second natural modes of vibration straddle the frequency of the maximum wave energy of a storm wave spectrum taken from the vicinity where said platform is to be located.

16. A method of claim 15 for reducing the dynamic amplification of design stress of a flexible platform due to oscillation so as to reduce material costs comprising:

installing guy lines with one end connected to the stiffened upper portion of said platform and the other end secured to subsea bottom so as to limit the motion of said flexible platform during unprecedented storm waves.

17. A method of reducing the forces on a marine offshore tower due to wind and wave forces, comprising:

forming a rigid working platform;

extending vertical support legs having ballast chambers within said leg from said rigid platform to the subsea bottom;

connecting the upper end of said legs to said working deck;

connecting ballastable horizontal members, each of said members designed to have a relatively uniform bending stress along the length of said horizontal member, said horizontal members being spaced a predetermined distance from each other and forming a joint at each horizontal and leg member;

connecting a plurality of elongated chambers at the upper end of said legs so that said elongated ballast chambers are exterior to said legs and extend vertically along said legs between a plurality of joints at each horizontal member and leg at the upper portion of said tower;

connecting a plurality of shorter buoyant chamber at each joint formed by said leg and a said horizontal member so that said shorter buoyant chambers are respectively exterior to said legs and said horizontal members at a plurality of said joints;

whereby said elongated chambers and said shorter elongated chambers assist said legs and said horizontal members to reduce the deadweight of said structure and the moment induced in said legs when said legs sway horizontally;

disposing said legs in said body of water so that said legs are pinned to said water bottom;

adjusting the ballast in said elongated ballast chambers, said shorter ballast chambers, said legs, and said horizontal members whereby said marine offshore tower is dynamically damped thus reducing the dynamic amplification of design stress.

18. A method as in claim 17 for reducing the forces on a marine offshore platform, further comprising:

stiffening the upper portion of said marine offshore tower so that the frequencies of the first and second natural modes of vibration straddle the maximum wave energy of a storm wave spectrum in the vicinity where said platform is to be located, which in turn reduces material costs.

19. A method as in claim 18 for reducing the forces on a marine offshore structure, further comprising: installing bracing in the plane of said horizontal members, said horizontal members being located a predetermined distances from each other.

20. A method as in claim 19 for reducing the forces on a marine offshore structure, further comprising:

installing guys connected at one end to the stiffened upper portion of said platform and at the other end to the subsea bottom so that the motion of said structure becomes limited during unprecedented storm waves.

21. A complaint platform for use in deep water comprising a structure including a working deck, a plurality of leg members positionable in a substantially vertical alignment from said working deck located above the water surface down into the sea floor, means for rigidly connecting said leg members to said working deck, means for pinning said leg members to said sea floor below said water and horizontal bracing members rigidly connected between said leg members; and vibration-influencing means on said structure providing the first mode of vibration of said compliant platform with a frequency less than the frequency of the peak of the spectral wave density profile expected in said water at the location of said compliant platform and the second mode of vibration of said compliant platform with a frequency greater than said frequency of the peak of the spectral wave density profile expected in said water at the location of said compliant platform.

22. The compliant platform of claim 21 further characterized in that the frequency of the first mode of vibration of said structure is at most one-half the frequency of the peak of the spectral wave density profile expected in said water.

23. A compliant platform for use in deep water comprising a structure including a working deck, a plurality of leg members positionable in a substantially vertical alignment from said working deck located above the water surface down into the sea floor, means for rigidly connecting said leg members to said working deck, means for pinning said leg members to said sea floor below said water and horizontal bracing members rigidly connected between said leg members; and vibration-influencing means on said structure for both providing said compliant platform with a ratio less than 0.3 between the frequencies of the first and second modes of vibration of the structure and providing the first mode of vibration of said compliant platform with a frequency less than the frequency of the peak of the spectral wave density profile expected in said water at the location of said compliant platform and a second mode of vibration of said compliant platform with a frequency greater than said frequency of the peak of the spectral wave density profile expected in said water at the location of said compliant platform.

24. The compliant platform of claim 23 further characterized in that the frequency of the first mode of vibration of said compliant platform is less than one-half the frequency of the peak of the spectral wave density profile expected in said body of water.

25. The compliant platform of claim 21 where the horizontal bracing members comprise the only underwater bracing between said legs.

26. The compliant platform of claim 21 where said vibration-influencing means comprise inwardly tapered portions on said horizontal bracing members to lower the frequency of the first mode of vibration of said structure.

27. The compliant platform of claim 26 where said vibration-influencing means also includes a stiffening means providing additional stiffness to said structure at selected levels of said leg members to raise the frequency of the second mode of vibration of said structure.

28. The compliant platform of claim 27 where said stiffening means comprises vertical diagonal x-bracing.

29. The compliant platform of claim 27 where said stiffening means comprises elongated buoyant chambers on said leg members.

30. The compliant platform of claim 21 where said leg members are tubular columns.

31. The compliant platform of claim 30 where the upper portions of said tubular columns have a smaller diameter than the diameter of the remaining portions of said tubular columns.

32. The compliant platform of claim 23 where the horizontal bracing members comprise the only underwater bracing between said legs.

33. The compliant platform of claim 23 where said vibration-influencing means comprise inwardly tapered portions on said horizontal bracing members to lower the frequency of the first mode of vibration of said structure.

34. The compliant platform of claim 26 where said vibration-influencing means also include a stiffening means providing additional stiffness to said structure at selected levels of said leg members to raise the frequency of the second mode of vibration of said structure.

35. The compliant platform of claim 27 where said stiffening means comprises vertical diagonal x-bracing.

36. The compliant platform of claim 27 where said stiffening means comprises elongated buoyant chambers connected to the exterior of said leg members.

37. The compliant platform of claim 23 where said leg members are tubular columns.

38. The compliant platform of claim 37 where the upper portions of said tubular columns have a smaller diameter than the diameter of the remaining portions of said tubular columns.

39. The compliant platform of claim 21 where the period of the first mode of vibration is in excess of 25 seconds.

40. The compliant platform of claim 21 where the period of the first mode of vibration is in the range of from 40 to 60 seconds.

41. The compliant platform of claim 21 where the period of the first mode of vibration is in excess of 25 seconds and the period of the second mode of vibration is less than 12 seconds, and the ratio of the first mode to the second mode is at least 3.3.

42. The compliant platform of claim 21 where the period of the first mode of vibration is in the range from 40 to 60 seconds and the period of the second mode of vibration is in the range of 9 to 12 seconds.

43. The compliant platform of claim 23 where the period of the first mode of vibration is in excess of 25 seconds.

44. The compliant platform of claim 23 where the period of the first mode of vibration is in the range of from 40 to 60 seconds.

45. The compliant platform of claim 23 where the period of the first mode of vibration is in excess of 25 seconds and the period of the second mode of vibration is less than 12 seconds, and the ratio of the first mode to the second mode is at least 3.3.

46. The compliant platform of claim 23 where the period of the first mode of vibration is in the range from 40 to 60 seconds and the period of the second mode of vibration is in the range of 9 to 12 seconds.

* * * * *